US007544280B2

(12) United States Patent
Shimizu

(10) Patent No.: US 7,544,280 B2
(45) Date of Patent: Jun. 9, 2009

(54) PLATING ANALYZING METHOD AND APPARATUS

(75) Inventor: Koichi Shimizu, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 856 days.

(21) Appl. No.: 10/946,616

(22) Filed: Sep. 22, 2004

(65) Prior Publication Data

US 2005/0241945 A1 Nov. 3, 2005

(30) Foreign Application Priority Data

Apr. 28, 2004 (JP) ..... 2004-134384

(51) Int. Cl.
*C25D 5/00* (2006.01)
*C25D 21/12* (2006.01)

(52) U.S. Cl. ..... 205/81; 205/794; 205/775; 204/298.03; 703/2

(58) Field of Classification Search ..... 700/266, 700/121; 205/775, 81, 794, 416; 204/298.03; 703/2

See application file for complete search history.

(56) References Cited

U.S. PATENT DOCUMENTS 6,542,784 B1 4/2003 Amaya et al.

FOREIGN PATENT DOCUMENTS

JP 2001-152397 6/2001

JP 2002-180295 12/2002

OTHER PUBLICATIONS

Pruis, G.W., et al. "A Comparison of Different Numerical Method for Solving the Forward Problem in EEG and MEG", Physiological Measurement, vol. 14, Supplement 4A, Nov. 1, 1993, pp. A1-A9.*

Nakajima, K., et al. "Comparison of Finite Element and Finite Volume Methods for Incompressible Viscous Flows", American Institute of Aeronuatics and Astronautics Journal, vol. 32, No. 5, May 1994, pp. 1090-1093.*

* cited by examiner

*Primary Examiner*—Alex Nogueroia
*Assistant Examiner*—J. Christopher Ball
(74) *Attorney, Agent, or Firm*—Fujitsu Patent Center

(57) ABSTRACT

A plating analyzing method is disclosed for analyzing an electroplating system having an anode, a cathode and plating liquid, based on a Laplace's equation. The method comprises the steps of making the Laplace's equation discrete by Finite Volume Method; forming simultaneous equations based on the discrete Laplace's equation; and calculating potential distribution using the simultaneous equations. A plating analyzing apparatus is also disclosed, which comprises a unit for making the Laplace's equation discrete by Finite Volume Method and dividing the system into a plurality of elements; potential calculating unit for forming simultaneous equations based on the discrete Laplace's equation, and calculating potential distribution using the simultaneous equations; and current density calculating unit for calculating current density distribution based on the potential distribution.

6 Claims, 7 Drawing Sheets

PLATING ANALYZING METHOD AND APPARATUS

BACKGROUND OF THE INVENTION

1. Field of the Invention

The present invention generally relates to a plating analyzing method and apparatus, and especially relates to such a method and apparatus in which a Laplace's equation is made discrete by the Finite Volume Method.

2. Description of the Related Art

As the design rule for fabricating semiconductors such as LSI is reduced more and more, large scale integration technology, chip downsizing technology, and SOC (System ON a Chip) technology for mixing logic and memory devices have been recently promoted to be developed. As these technologies advance, it has been strongly required to increase the number of bonding pads formed on one chip surface and miniaturize outer wirings connecting such bonding pads and inner wirings within the chip.

Multiple wiring structure having dual damascene wiring structure using Cu material has been adapted for semiconductors. The dual damascene wiring structure has good planarity of each wiring layer because each wiring is planarized by the CMP method. Therefore, electric short circuit between wiring layers can be easily inhibited, and that is especially preferable for the purpose of multiplying layers.

Cu material used for wiring layers and vertical wirings for via, etc. is deposited usually by an electroplating process. Because of the wiring rule progress, semiconductors having wiring distances less than several ten nm have been announced. On the other hand, larger wafers such as 300 mm diameter wafers for fabricating semiconductor chips are promoted. Under this situation, it is desired to form a Cu layer having uniform thickness over the whole surface of a wafer. As for semiconductors having high speed operation purpose, Au material is now considered to be used for wirings and substrate penetrating electrodes in order to reduce wiring resistances.

As a method for forming such bonding pads or wirings, an electroplating method, one of wet processes, can be employed. In the electroplating method, a conductor to be plated is placed as a cathode in a plating bath filled with plating liquid. Metal material for plating is also placed as an anode in the plating bath. And electric power is supplied between the anode and the cathode to form plating film or layer on the surface of the cathode conductor.

A plating analyzing method is proposed, in which a computer is used for numerically analyzing the condition of electroplating in order maximize a speed for forming electroplating on the cathode and optimize the arrangement of the anode. For example, Japanese Patent Laid-open Publications Nos. 2002-180295 and 2001-152397 propose a plating technique where in a plating system having an anode, a cathode and plating liquid, a Laplace's equation as a controlling equation is made discrete by the Finite Element Method (FEM) to obtain electric current densities and potential distribution in the system.

In the Finite Element Method, the system is finely divided into many meshes, and a node of each mesh is given unknown quantity such as potential, and a Laplace's equation is made discrete. Potentials between nodes are represented by interpolating functions. In order to obtain equations at nodes, simultaneous equations are calculated with using weighting functions.

FIG. 1 shows an electroplating apparatus 100, which comprises an anode 101, a cathode 102, and plating liquid 103. In this apparatus 100, plating film or layer is selectively deposited onto an exposed portion of conductor 102a of the cathode 102, which is in contact with the plating liquid 103. In this case, polarization voltage η generates on the conductor 102*a* surface of the cathode. As shown in FIG. 1, the electroplating system is made discrete by Finite Element Method, and boundaries between the conductor 102*a* and the insulator 102 become nodes $a_1$ and $a_2$. To each of the nodes a1, a2, two potentials Vc and Vc+η should be designated. In this case, an interpolation error due to the two potentials designated at the nodes $a_1$, $a_2$ affects neighborhood nodes $b_1$-$b_6$, resulting in a problem that an analysis error becomes larger.

Further, in the Finite Element Method applied to the nodes a1, a2 as shown in FIG. 1, plating electric currents are represented at both sides of the conductor 102*a* surface, and therefore electric current is not conserved between an element on the conductor 102*a* side of the conductor surface 102*a*-1 and an element on the plating liquid 103 side of the conductor surface 102*a*-1. Accordingly, another problem is that an electric current flowing through the boundary (conductor surface 102*a*-1) cannot be accurately calculated.

In order to solve these problems, it is possible to finely divide elements into small pieces to have many nodes on the conductor surface. However, as the number of elements increases, the time required for analyzing becomes longer.

SUMMARY OF THE INVENTION

Accordingly, it is a general object of the present invention to provide a simple and high accurate plating analyzing method, a program thereof and a plating analyzing apparatus.

According to one aspect of the present invention, a plating analyzing method for analyzing an electroplating system having an anode, a cathode and plating liquid, based on a Laplace's equation, is disclosed. The method comprises the steps of making the Laplace's equation discrete by the Finite Volume Method; forming simultaneous equations based on the discrete Laplace's equation; and calculating potential distribution using the simultaneous equations.

According to this aspect, the electroplating system is made discrete by the Finite Volume Method based on a three dimensional Laplace's equation. Even if there is a sudden potential difference between elements, such as elements on the cathode surface, it is possible to highly accurately analyze by making the element face coincide with the cathode surface and providing potential difference between two elements, whose element face is a boundary face. Accordingly, this method can more accurately analyze the system comparing to the Finite Element Method.

The step of making the Laplace's equation discrete may comprise the steps of dividing the electroplating system into a plurality of elements; and giving unknown potentials in the elements to the Laplace's equation. The elements may be three dimensional elements. The method may be characterized by making a two-dimensional element face of an element coincide with a surface of the anode or the cathode; and taking a difference between a first potential in an anode side or cathode side element having the two-dimensional element face as its boundary and a second potential in a plating liquid side element having the two-dimensional element face as its boundary, as a polarization voltage. It is possible to reduce the number of elements and shorten the time required for calculation.

The cathode surface may comprise a conducting region in which an electric current flow from the plating liquid, and a non-conducting region in which no electric current flows; and an element face may coincide with the conducting region or the non-conducting region. It is possible to calculate current density of an electric current flowing through the conducting region.

The element face may be designated so as to include the conducting region and the non-conducting region. The current density flowing through the element face may be determined based on a current density of an electric current flowing through the conducting region and a ratio of an area of the conducting region to the whole area of the element face.

In a case where the cathode surface includes a conducting region and a non-conducting region, it is possible to reduce the number of elements and simplify the system by dividing the element face into a conducting region and a non-conducting region. By indicating current density of an electric current flowing through the element face, based on a current density of an electric current flowing through the conducting region and a conducting area percentage, it is possible to secure the matching relations between current density of an electric current flowing through a conducting regions and polarization voltage.

According to another aspect of the present invention, a computer program is provided for carrying out the plating analyzing method.

By separating the plating system and making it discrete by the Finite Volume Method, current density and potential distribution can be analyzed highly accurately, and the number of elements can be reduced to shorten the required time.

According to another aspect of the present invention, a plating analyzing apparatus is provided for analyzing an electroplating system having an anode, a cathode and plating liquid, based on a Laplace's equation. The plating analyzing apparatus comprises a unit for making the Laplace's equation discrete by Finite Volume Method and dividing the system into a plurality of elements; potential calculating unit for forming simultaneous equations based on the discrete Laplace's equation, and calculating potential distribution using the simultaneous equations; and current density calculating unit for calculating current density distribution based on the potential distribution.

By separating the plating system and making it discrete by the Finite Volume Method, current density and potential distribution can be analyzed highly accurately, and the number of elements can be reduced to shorten the required time.

FIG. 2 shows an electroplating apparatus in order to explain a principle of the present invention. Referring to FIG. 2, the electroplating apparatus 10 comprises an anode 11, a cathode 12, plating liquid 13, a power supply 14 for supplying power between the anode 11 and the cathode 12. A surface of the cathode 12 to be plated comprises partially a conductor 12*a* providing cathode function, similar to FIG. 1. The electroplating system like this is made discrete by the Finite Volume Method. An element $EL_1$ is designated so as to have a conducting surface 12*a*-1 as one element face $S_0$. Another element $EL_2$ is designated at the plating liquid side so as to have the common element face $S_0$. In the Finite Volume Method, unknown quantity, for example an electrical potential is given to the center or the center of gravity of an element. That is, a potential $V_c$ is given at the center Al of the element $EL_1$, a potential $V_c+\eta$ is given at the center A2 of the element $EL_2$. The $\eta$ is polarization voltage generated at the element face. In the Finite Volume Method, since no interpolating function is required unlike the Finite Element Method, the polarization voltage affects only to the element $EL_2$ having a boundary at the conductor surface, and does not affect to any other element such as $EL_3$, $EL_4$. An electric current i passing the conducting surface 12*a*-1 is determined by the potential at the center $A_2$ of the element and distance to the element face S0 (conducting surface), and the electric current amount is conserved in the element. Therefore, it is possible to analyze more accurately than in the Finite Element Method. All we have to do is to designate an element having the conducting surface as an element face, and therefore the number of elements (meshes) can be reduced, and the number of simultaneous equations can be reduced to shorten the total analysis time.

According to the embodiments of the present invention, by making the electroplating system discrete using the Finite Volume Method, even if there is a potential difference between neighboring potential energies, it is still possible to highly accurately analyze the system because that electrical currents in elements are conserved.

Features and advantages of the present invention are set forth in the description that follows, and in part will become apparent from the description and the accompanying drawings, or may be learned by practice of the invention according to the teachings provided in the description. Objects as well as other features and advantages of the present invention will be realized and attained by a panel particularly pointed out in the specification in such full, clear, concise, and exact terms as to enable a person having ordinary skill in the art to practice the invention.

DESCRIPTION OF THE PREFERRED EMBODIMENTS

In the following, embodiments of the present invention are described with reference to the accompanying drawings.

Figure 1:
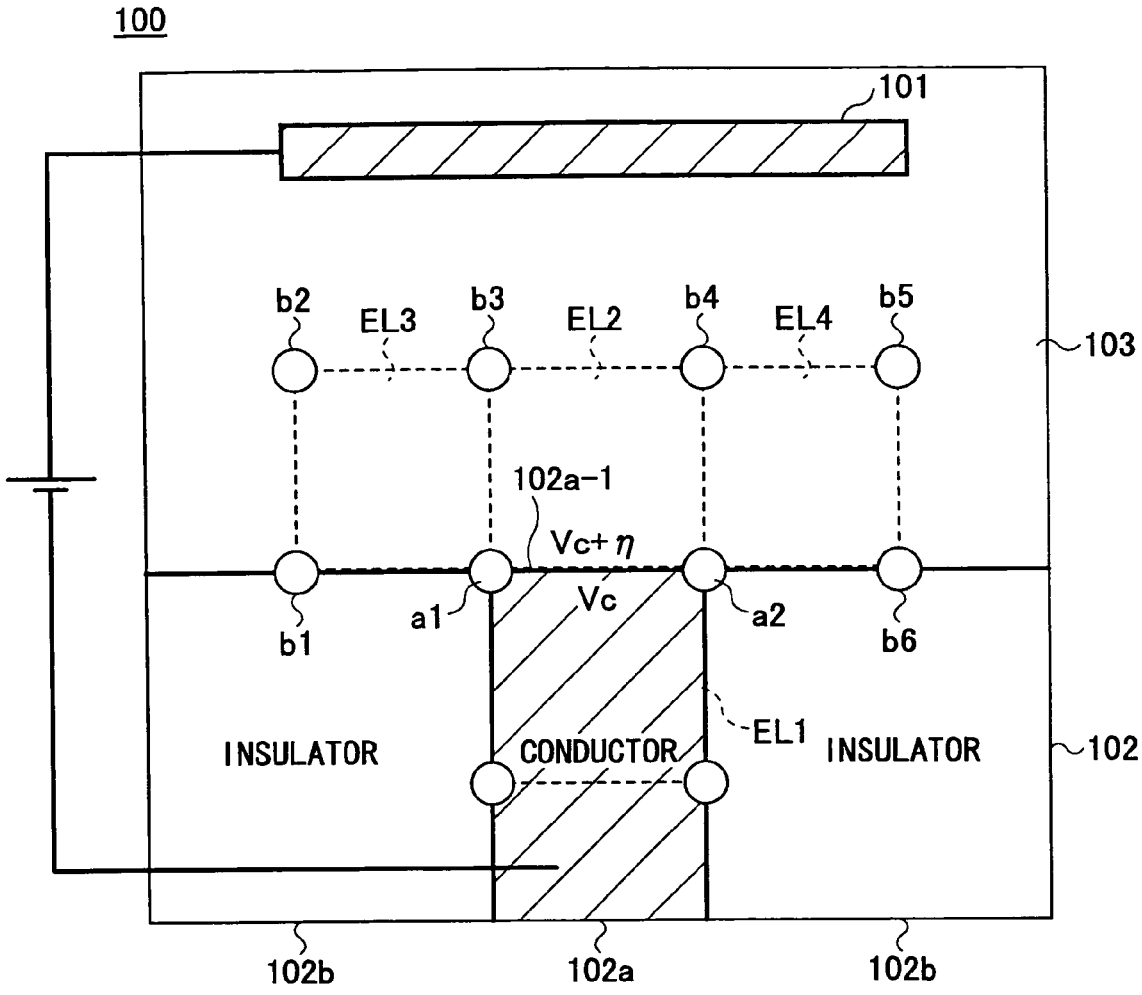
FIG. 1 shows a basic structure of an electroplating system, illustrating a prior art problem.
Figure 2:
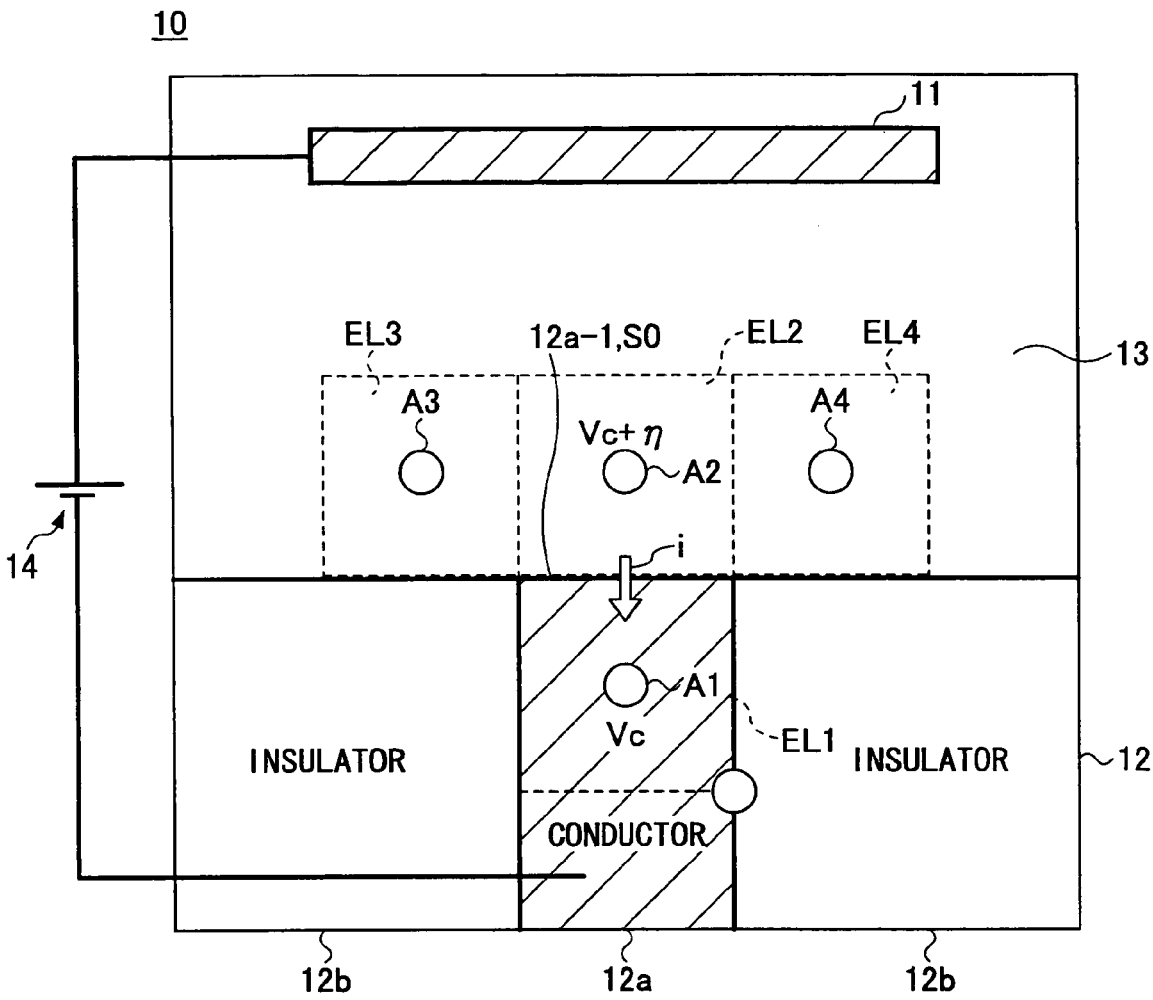
FIG. 2 shows a basic structure of an electroplating system, illustrating a principle of a plating analyzing method according to the present invention.
Figure 3A:
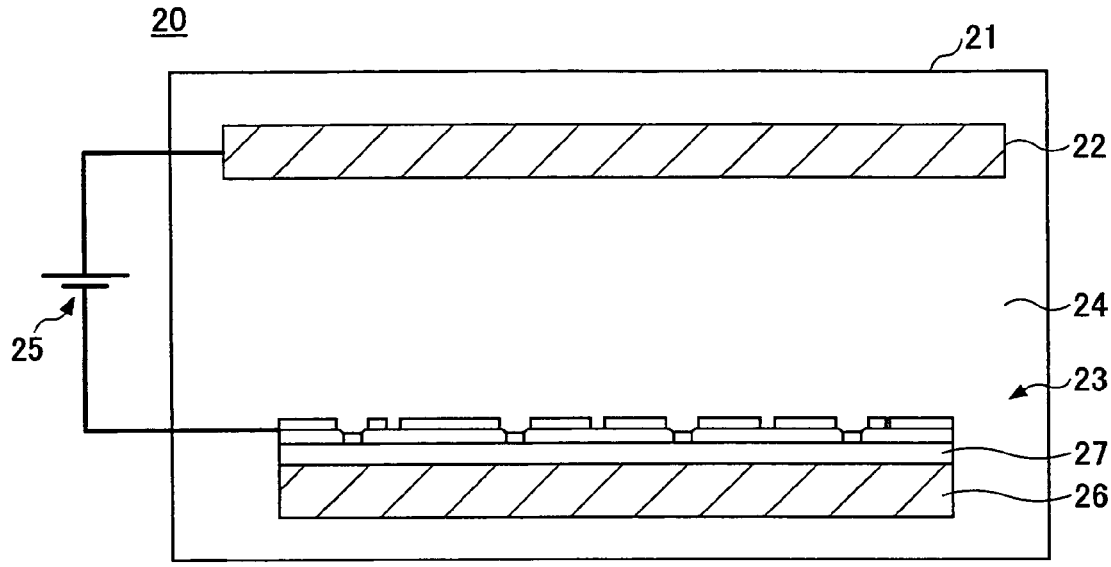
FIG. 3A shows an electroplating system used fro carrying out a first embodiment of the present invention and FIG. 3B is an extended cross sectional view of a cathode surface.
Figure 3B:
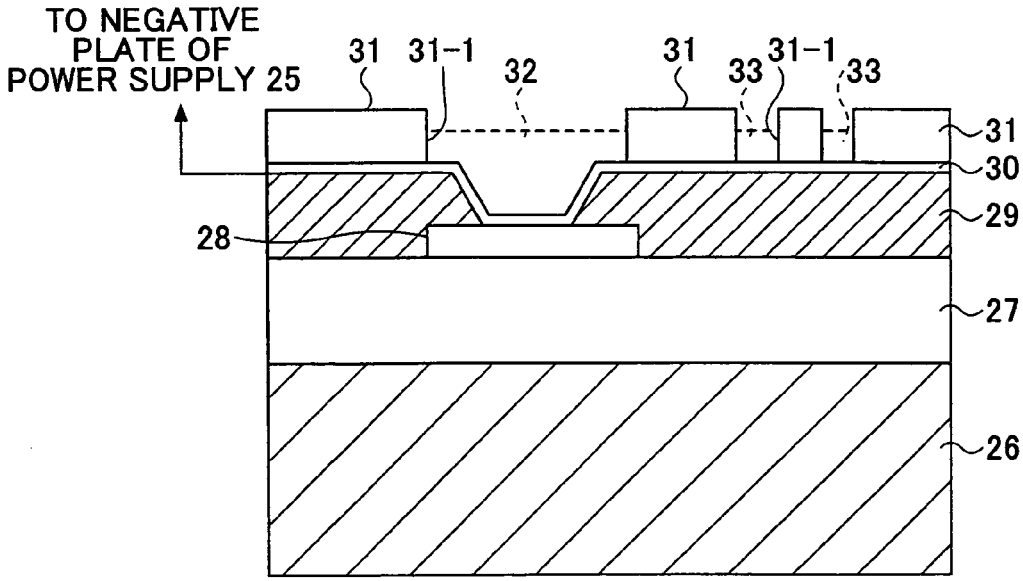

FIG. 3A shows a basic structure of an electroplating system, to which a plating analyzing method according to a first embodiment of the present invention can be applied. FIG. 3B is an extended cross sectional view of a surface portion of a cathode shown in FIG. 3A.

Referring to FIGS. 3A and 3B, an electroplating apparatus 20 comprises a plating bath 21, an anode 22 made of plating material and placed within the plating bath 21, a cathode 23 on which a plating layer is to be deposited, plating liquid 24 filled in the plating bath 21, and a power supply 25 supplying power between the anode 22 and the cathode 23. In the apparatus shown in FIGS. 3A and 3B, a bonding pad 32 and outer layer wirings 33 are formed by electroplating on a surface of an inner wiring layer 27. The inner wiring layer 27 is placed on a substrate 26 and has transistors and inner layer wirings therein. As shown in FIG. 3B, on the surface of the inner wiring layer 27 is formed an inner conductor 28, an inter-layer insulator 29, a plate seed layer 30 made of sputtered conducing material like Cu, etc., and a resist layer 31 in order. The resist layer 31 is patterned and openings 31-1 are formed to selectively expose the plate seed layer 3. By connecting a negative plate of the power supply 25 to the plate seed layer 30, conducting material such as Al, Cu, Au, etc. is filled in the openings 31-1 by electroplating. Thereafter, the resist layer 31 and the plate seed layer 30 thereunder are selectively removed to maintain a bonding pad 32 and outer layer wirings 33.

In this situation, when connecting power to the plate seed layer 30, the cathode surface is divided to two regions, a conducting region (the openings 31-1 exposing the plate seed layer 30 shown in FIG. 3B) in which electric current flows from the plating liquid, and a non-conducting region (region formed by the resist layer 31).

As mentioned above regarding the plating analyzing method according to the present invention, it is possible to analyze by designating each conducting region as one element, when making discreteness by the Finite Volume Method. Comparing to the Finite Element Method, the number of elements can be reduced and the calculating time can be shortened by reducing the number of simultaneous equations. This embodiment can further simplify and reduce the number of elements.

Figure 4:
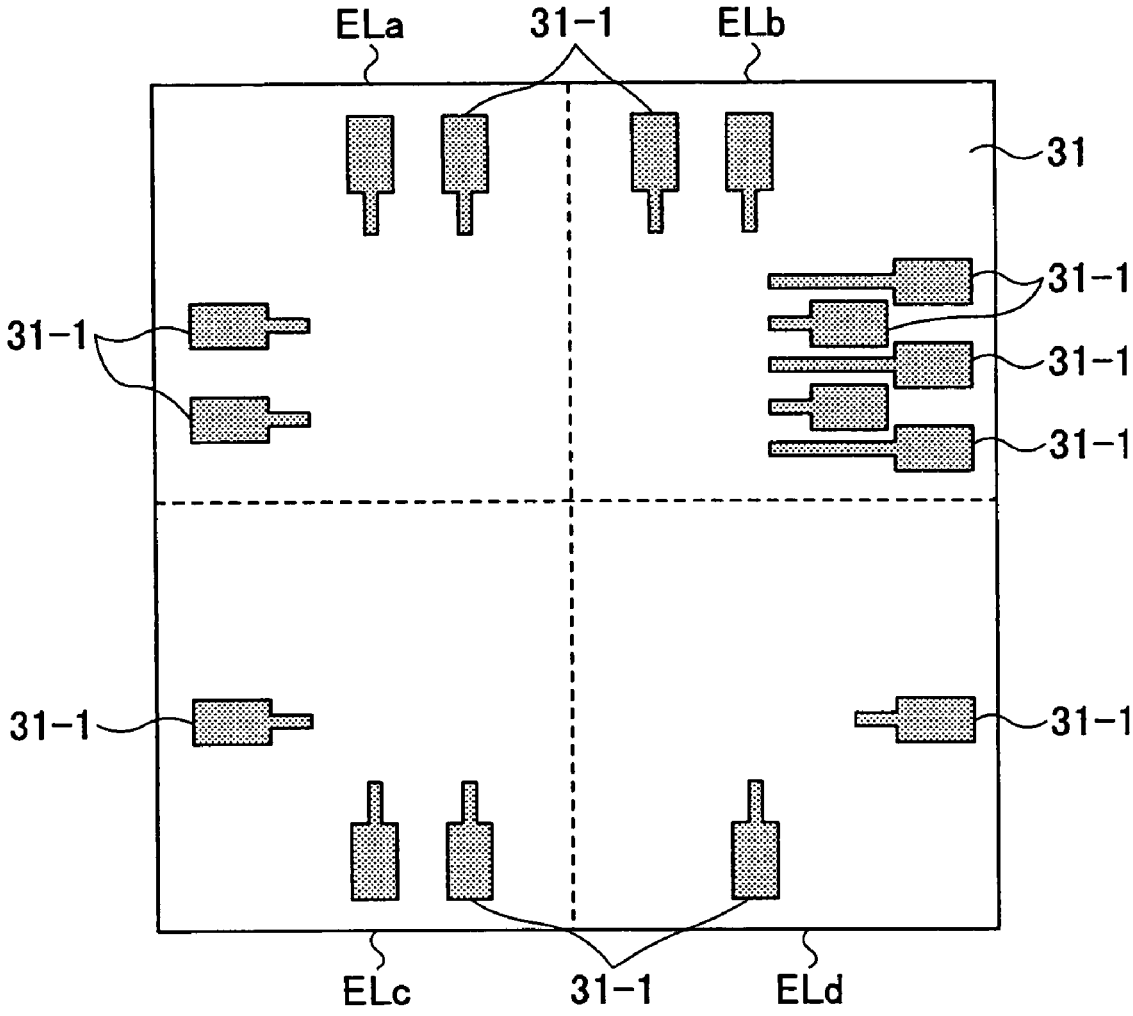
FIG. 4 is an extended top plan view of a cathode surface, on which plating layer is formed.

FIG. 4 is an extended top plan view of the cathode surface on which the plating layer is formed. Referring to FIG. 4, the wafer surface for receiving the plating layer thereon is divided into 4 element faces ELa-ELd. Each of the element faces ELa-ELd includes a plurality of openinings 31-1 and the resist layer shown in FIG. 3B. In each element face, openings 31-1 are the conducting regions where an electric current flows from the plating liquid when plating. A ratio of the conducting regions to the area of the element face ELa-ELd (conducting region percentage) can be represented by A=(Area of the conducting regions)/(Area of the element)×100. For example, it is determined after calculation that each of the elements 1-4 has conducting region percentage of 20%, 40%, 15% and 10%, respectively. Here we can call the density of electric current flowing through the element faces ELa-ELd "Element face current density I", and assume that the density of an electric current flowing through the openings is represented by i. Then the Element face current density I can be written $$I=A\times i$$

In this way, the system can be divided to simple discrete elements that are simplified, by using the Finite Volume Method.

Figure 5:
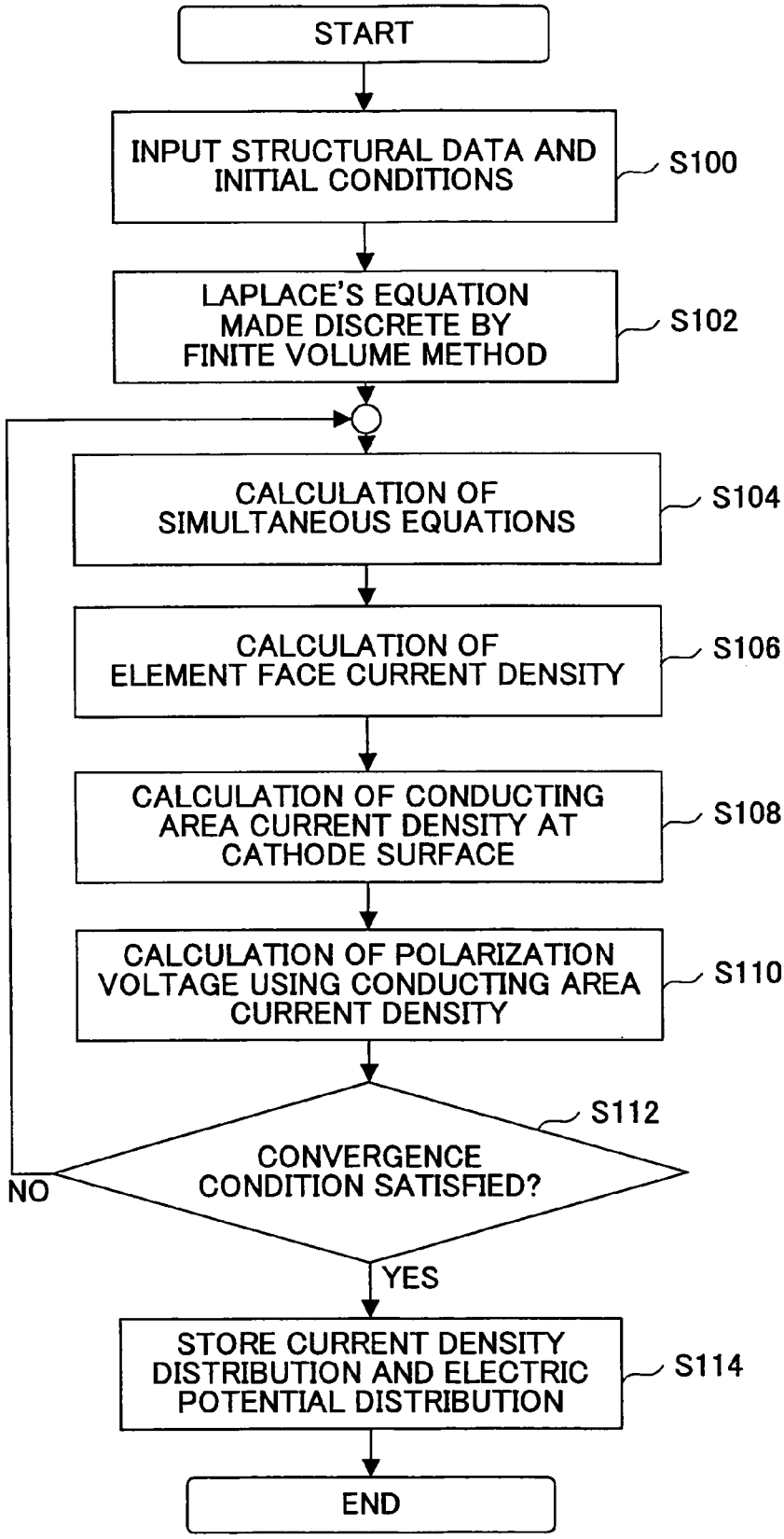
FIG. 5 shows a flow chart illustrating procedures of analyzing electroplating conditions according to a second embodiment of the present invention.

FIG. 5 is a flow chart showing procedures of an analyzing method according to a second embodiment of the present invention. Referring to FIG. 5, an explanation is given for the analyzing method of the electroplating system shown in FIGS. 3A and 3B.

First, input structural data of the electroplating system, and initial conditions such as cathode electric current, conductivity depending on the plating liquid, polarization voltages at the anode and cathode surfaces determined by an experiment (S100).

Next, a Laplace's equation is made discrete by the Finite Volume Method (S102). An electric potential $\phi$ of the system comprising the anode, the cathode and the plating liquid is in accordance with the following equations (1).

Equation (1)

$$\iiint \vec{\nabla}\cdot\left(\sigma\vec{\nabla}\phi\right)dV = 0 \tag{1}$$

This equation (1) can be changed to the following equation (2) by the Green's theorem.

Equation (2)

$$\iiint \vec{\nabla}\cdot\left(\sigma\vec{\nabla}\phi\right)dV = \iint \sigma\vec{\nabla}\phi\cdot d\vec{S} = 0 \tag{2}$$

The system is divided into three dimensional elements, and their electric potential is determined by the one at their center of gravity, then discreteness is performed. Figures of elements may be various figures such as a tetrahedron having triangle elements, a triangle pole like a prism, a pyramidal shape, a hexahedron having quadrangular elements. These elements are designated and the conducting region percentage Ai is calculated. As a result of making discreteness, the above equation (2) can be represented by the following summation form with respect to element face dSi.

Equation (3)

$$\iint \sigma\vec{\nabla}\phi\cdot d\vec{S} = \sigma\sum_{i}^{Nface}\left(\vec{\nabla}\phi\right)_i dS_i = 0 \tag{3}$$

The gradient of the electric potential $\phi$ means component perpendicular to the element face dSi.

Figure 6:
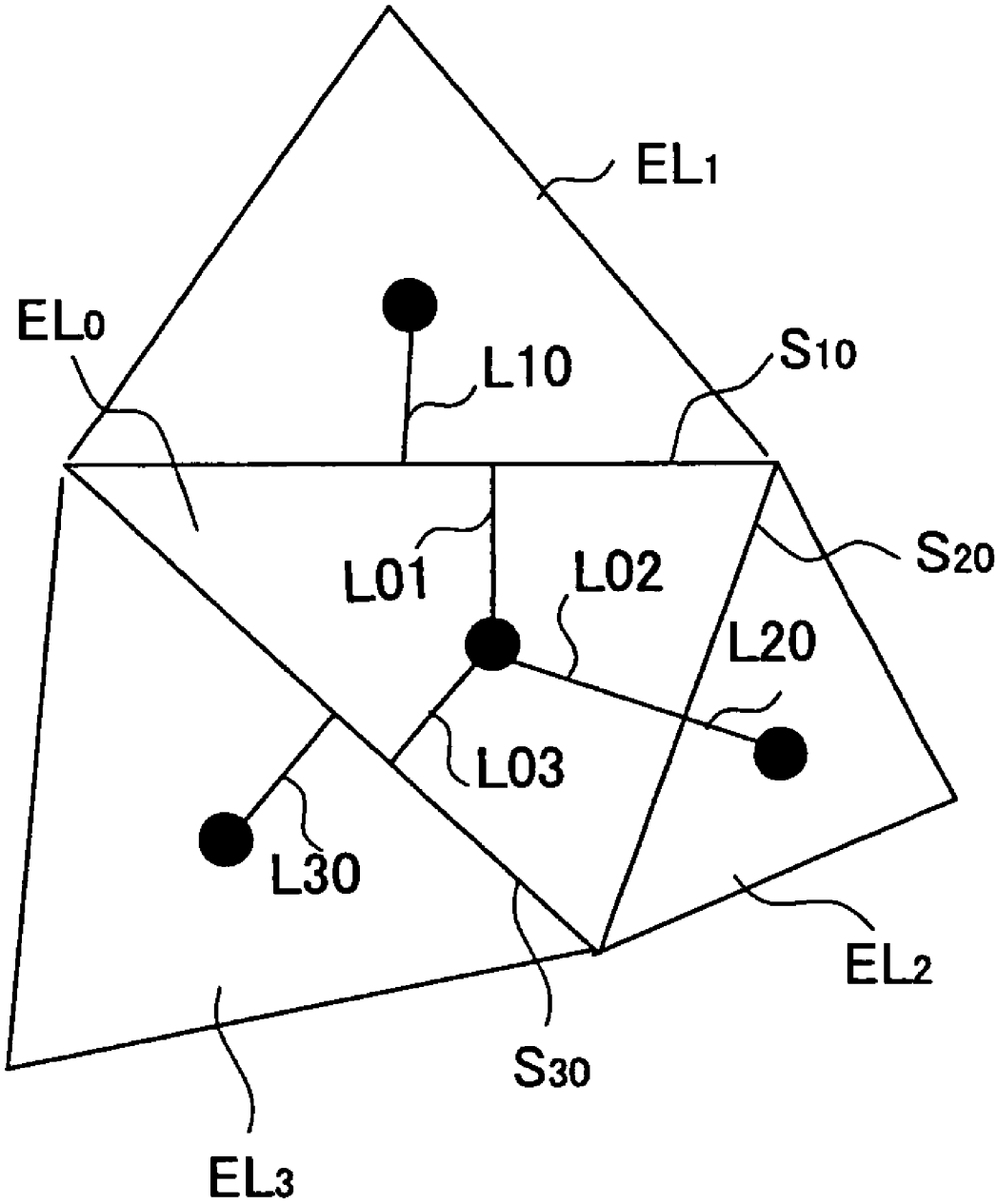
FIG. 6 shows an example where an electroplating system made discrete.

FIG. 6 shows an exemplified case where the electroplating system is made discrete. Referring to FIG. 6, a portion of the system is divided to elements $EL_0$-$EL_3$. In this case, the above equation (3) can be represented by the following equation (4) except at the interfaces between the plating liquid, and the anode and the cathode.

Equation (4)

$$0 = \sigma\sum_{i}^{Nface}\left(\vec{\nabla}\phi\right)_i dS_i = \sigma\sum_{i}^{Nface}\frac{\phi_i-\phi_0}{(L_{i0}+L_{0i})}dS_i = \sigma\left(\frac{\phi_1-\phi_0}{(L_{10}+L_{01})}dS_1 + \frac{\phi_2-\phi_0}{(L_{20}+L_{02})}dS_2 + \frac{\phi_3-\phi_0}{(L_{30}+L_{03})}dS_3\right)$$

Wherein $\phi_i$ is an electric potential at the center of gravity of the ith element $EL_i$, $L_{ij}$ means a distance from the center of gravity of the element ELi to the boundary $S_{ij}$ face between the elements ELil and $EL_j$.

And at the boundary faces between the plating liquid, and the anode and the cathode, that are reactive faces, an element face $dS_1$ is selected so as to coincide with the reactive face. And therefore the above equation (3) for element 0 can be represented by the following equation (5) for Equation (5)

$$0 = \sigma \sum_{i}^{Nface} \left(\vec{\nabla}\phi\right)_i dS_i = \sigma\left(\frac{\phi_1 - \phi_0 - \eta}{(L_{10} + L_{01})} dS_1 + \frac{\phi_2 - \phi_0}{(L_{20} + L_{02})} dS_2 + \frac{\phi_3 - \phi_0}{(L_{30} + L_{03})} dS_3\right) \quad (5)$$

Wherein, $\eta$ means polarization voltage. The polarization voltage is previously obtained through an experiment. Herein it is assumed as an initial condition that $\eta=\eta_0$. Where the reactive face lies at the cathode surface, $\eta_0>0$.

In this manner, based on the above equations (4) and (5) generated for each element, resultant simultaneous equations can be calculated to obtain solutions $\phi_i$ (S104).

Next, based on the solutions $\phi_i$, the current density $I_i$ (herein after referred to as "Element face current density") of electric current flowing through the element face d $S_i$ is obtained using the following equation (6).

Equation (6)

$$I_i = -\sigma\nabla\phi_i \quad (6)$$

Herein, the Element face current density is obtained by dividing an electric current flowing through the element face by the area of the element face. At the element face designated at the cathode surface, as shown in FIG. 3B, there exist both a conducting region and non-conducting region microscopically. The conducting are is an opening area exposing the plate seed layer.

An electric current density $i_i$ of an electric current flowing through the conducting region (herein after referred to as "Conducting region current density") is related to the Element face current density $I_i$ by the following equation (7) (S108).

Equation (7)

$$i_i = \frac{100}{A_i} I_{in} \quad (7)$$

Wherein component normal to the element face is $I_{in}$. $A_i$ means the conducting region percentage of the ith element, that is, a ratio of the conducting region area to the element face area.

Next, the above mentioned polarization voltage $\eta_i$ can be obtained using the Conducting region current density $i_i$ by the following equation (8) (S110). Therefore, in the equation (8) between the polarization voltage and the Conducting region current density, the relation of the polarization voltage and the Element face current density is matched by the above equation (7).

Equation (8)

$$\eta_i = a + bi_i + c \log i_i \quad (8)$$

In a case where the following convergence condition (9) is not satisfied, the $\eta$ in the above equation (8) is substituted into the above equation (5). At the anode surface, the whole surface is conducting region, and therefore its Element face current density and Conducting region current density are the same. In the polarization voltage at the anode surface, its coefficients a, b and c in the above equation (8) are different from those at the cathode surface.

Next, the procedures from S104 to S110 are repeated until the following convergence condition (9) is satisfied. That is, the procedures are repeated until that the Conducting region current density $i_i^n$ obtained by the nth calculation becomes near to its previous Conducting region current density $i_i^{n-1}$ within a predetermined error of $\in$.

Equation (9)

$$|i^n - i^{n-1}| < \in \quad (9)$$

In a case where the above convergence condition (9) is satisfied, the thus obtained current density and electric potential distribution data are stored. (S114). In this manner, the electric potential distribution and the current density distribution of the system can be calculated. Further, based on the electric potential distribution and the current density distribution of the system, the thickness distribution, etc. of the plate layer at the cathode surface can be calculated.

A plating analyzing apparatus according to a third embodiment of the present invention is now explained below. In the explanation, the analyzing apparatus analyzes electroplating conditions in a case where there exist both a conducting region and a non-conducting region at the cathode surface as shown in FIGS. 3-6.

Figure 7:
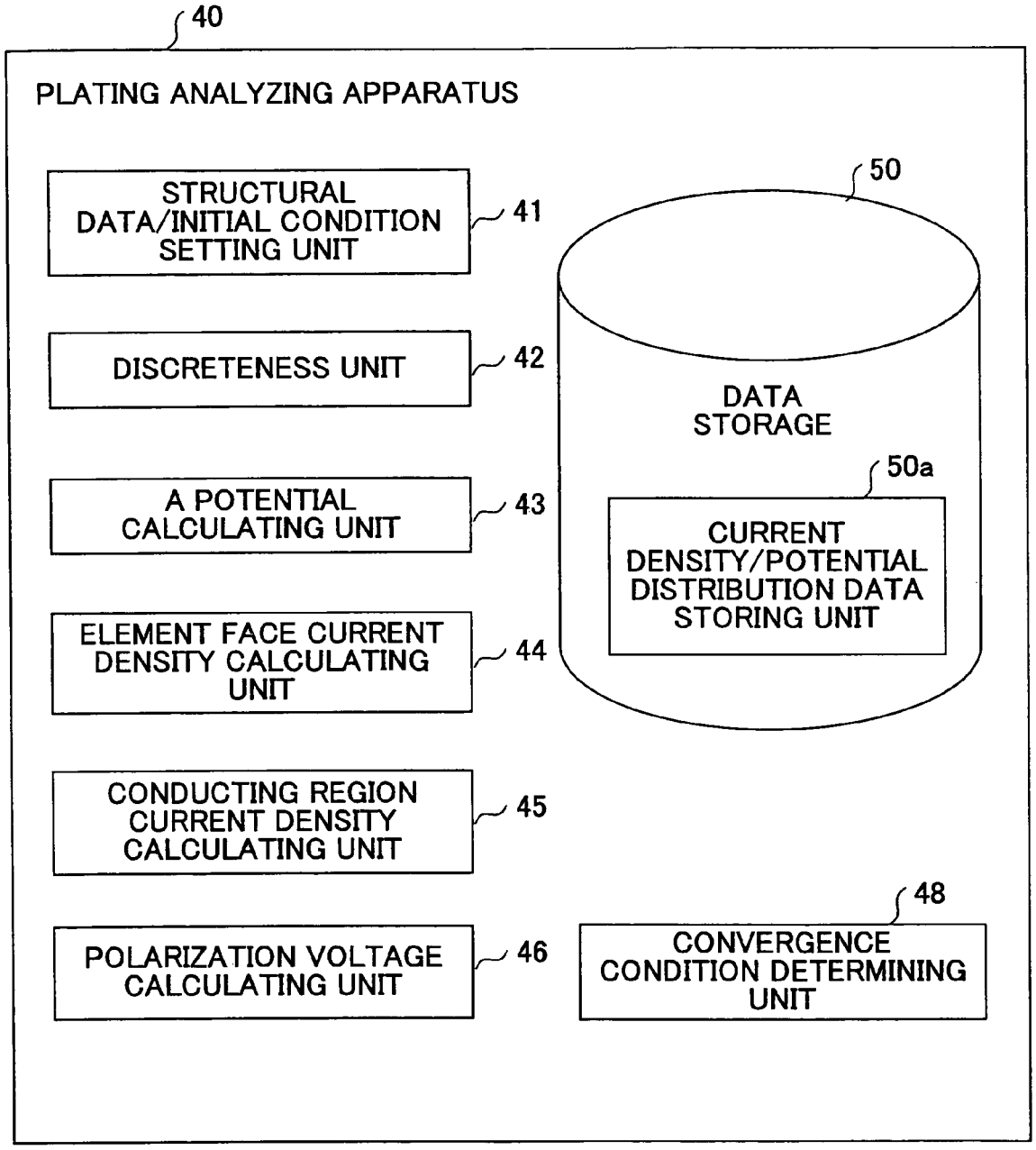
FIG. 7 is a block diagram of a plating analyzing apparatus according to a third embodiment of the present invention.

FIG. 7 is a block diagram of a plating analyzing apparatus 40 according to the third embodiment of the present invention. Referring to FIG. 7, the apparatus 40 comprises a structural data/initial condition setting unit 41, a discreteness unit 42, a potential calculating unit 43, an element face current density calculating unit 44, a conducting region current density calculating unit 45, a polarization voltage calculating unit 46, a convergence condition determining unit 48 and data storage 50.

The structural data/initial condition setting unit 41 is configured so as to set structural data and initial conditions for analyzing electroplating. For example, the structural data/initial condition setting unit 41 is adapted to be able to set the structural data for electroplating system, cathode electric current, a conductivity $\sigma$ depending on plating liquid, polarization voltages at anode and cathode surfaces determined by experiments, etc.

The discreteness unit 42, based on the structural data of the electroplating system, makes the Laplace's equation in the above equation (3) discrete. At the cathode surface, a Conducting region percentage Ai for each element face is calculated.

The potential calculating unit 43 is configured so as to calculate simultaneous equations obtained in the discreteness unit 42, and provide electric potential for each element.

The element face current density calculating unit 44 is configured so as to obtain a current density of an electric current flowing through an element face by the above equation (6), based on the electric potential obtained in the potential calculating unit 43.

The conducting region current density calculating unit 45 is configured so as to calculate a current density $i_i$ of an electric current flowing a conducting region by the above equation (7), based on the current density of the electric current flowing through the element face at the cathode surface obtained by the element face current density calculating unit 44, and a conducting region percentage $A_i$ of the element face.

The polarization voltage calculating unit 46 is configured so as to calculate polarization voltage $\eta$ by using the equation (8), based on the current density $i_i$ of the electric current flowing through the conducting region obtained in the conducting region current density calculating unit 45. The equation (8) relates a current density $i_i$ obtained by an experiment to polarization voltage.

The convergence condition determining unit 48 is configured so as to determine if the convergence condition represented by the equation (9) is satisfied or not. For example, the convergence condition determining unit 48 determines whether the difference between a current density of an electric current flowing through a conducting region obtained by the repeated calculations and last time current density is less than a predetermined error value. If the difference is more than the error value, the procedure goes back to potential calculating unit 43 to calculate again. If the difference is less than or equal to the error value, the calculated current density and potential distribution data are stored in a current density/potential distribution data storing unit 50*a* in the data storage 50.

The data storage 50 is configured so as to store data used for the above mentioned structural data/initial condition setting unit 41, the conducting region percentage calculated when making discreteness, and so on, in addition to the calculated current density and potential distribution data. The data storage 50 comprises storing devices, for example, semiconductor memories such as RAM, hard disk, optical disk, etc.

The plating analyzing apparatus 40 is configured as mentioned above, and its functions are carried out using a computer according to the above analyzing method.

In the above explained embodiments, a cathode surface has both a conducting region and non-conducting region. The present invention, however, can be applied to a case where the whole cathode surface is conducting region. By employing the Finite Volume Method, en electric current in each element is conserved or maintained, and therefore it is possible to calculate a current density and potential distribution accurately better than the Final Element Method.

The above embodiments are explained in a case where a bonding pad and outer layer wirings are formed on a semiconductor device having transistors and wirings on a substrate. The present invention, however, is not limited to the case, but can be preferably applied to other cases where a plating bump of Au or solder is formed on a pad, or wirings are formed on a electric circuit board such as build-up wiring board.

Further, the present invention is not limited to these embodiments, but various variations and modifications may be made without departing from the scope of the present invention.

The present application is based on Japanese Priority Application No. 2004-134384 filed on Apr. 28, 2004, with the Japanese Patent Office, the entire contents of which are hereby incorporated by reference.

What is claimed is:

1. A plating analyzing method for analyzing an electroplating system having an anode, a cathode and plating liquid, based on a Laplace's equation, the method comprising:

making the Laplace's equation discrete by a Finite Volume Method including dividing the electroplating system into a plurality of three-dimensional elements and giving values for unknown potentials of the three-dimensional elements to the Laplace's equation;

forming equations based on the discrete Laplace's equation; and calculating potential distribution using the equations, wherein said making the Laplace's equation discrete comprises:

making a first two-dimensional element face of a three-dimensional element coincide with an anode surface or a cathode surface;

taking a difference between a first potential in an anode side or cathode side element having the first two-dimensional element face as its boundary and a second potential in a plating liquid side element having the first two-dimensional element face as its boundary, as a polarization voltage, said cathode surface including a conducting region in which an electric current flows from the plating liquid and a non-conducting region in which no electric current flows;

making a second two-dimensional element face coincide with the conducting region or the non-conducting region;

designating a third two-dimensional element face to include the conducting region and the non-conducting region; and determining a current density flowing through the third two-dimensional element face based on a current density of an electric current flowing through the conducting region and a ratio of an area of the conducting region to an entire area of the third two-dimensional element face which is designated to include the conducting region and the non-conducting region.

2. The plating analyzing method as claimed in claim 1, wherein the potentials in the three-dimensional elements are taken at the center of gravity of the three-dimensional elements.

3. A computer-readable medium storing a program which, when executed by a computer, causes the computer to perform a plating analyzing method for analyzing an electroplating system having an anode, a cathode and plating liquid, based on a Laplace's equation, the method comprising:

making the Laplace's equation discrete by a Finite Volume Method including dividing the electroplating system into a plurality of three-dimensional elements and giving values for unknown potentials of the three-dimensional elements to the Laplace's equation;

forming equations based on the discrete Laplace's equation; and calculating potential distribution using the equations, wherein said making the Laplace's equation discrete comprises:

making a first two-dimensional element face of a three-dimensional element coincide with an anode surface or a cathode surface;

taking a difference between a first potential in an anode side or cathode side element having the first two-dimensional element face as its boundary and a second potential in a plating liquid side element having the first two-dimensional element face as its boundary, as a polarization voltage, said cathode surface including a conducting region in which an electric current flows from the plating liquid and a non-conducting region in which no electric current flows;

making a second two-dimensional element face coincide with the conducting region or the non-conducting region;

designating a third two-dimensional element face to include the conducting region and the non-conducting region; and determining a current density flowing through the third two-dimensional element face based on a current density of an electric current flowing through the conducting region and a ratio of an area of the conducting region to an entire area of the third two-dimensional element face which is designated to include the conducting region and the non-conducting region.

4. The computer-readable medium as claimed in claim 3, wherein the potentials in the three-dimensional elements are taken at the center of gravity of the three-dimensional elements.

5. A plating analyzing apparatus for analyzing an electroplating system having an anode, a cathode and plating liquid, based on a Laplace's equation, comprising:

a unit to make the Laplace's equation discrete by a Finite Volume Method including dividing the electroplating system into a plurality of three-dimensional elements and giving values unknown potentials of the three-dimensional elements to the Laplace's equation;

potential calculating unit to form equations based on the discrete Laplace's equation, and to calculate potential distribution using the equations; and current density calculating unit to calculate current density distribution based on the potential distributions, wherein said unit to make the Laplace's equation discrete comprises:

a first part to make a first two-dimensional element face of a three-dimensional element coincide with a surface of the anode or the cathode;

a difference calculating part to take a difference between a first potential in an anode side or cathode side element having the first two-dimensional element face as its boundary and a second potential in a plating liquid side element having the first two-dimensional element face as its boundary, as a polarization voltage, said cathode surface including a conducting region in which an electric current flows from the plating liquid and a non-conducting region in which no electric current flows;

a second part to make a second two-dimensional element face coincide with the conducting region or the non-conducting region;

a third part to designate a third two-dimensional element face to include the conducting region and the non-conducting region; and a determining part to determine a current density flowing through the third two-dimensional element face based on a current density of an electric current flowing through the conducting region and a ratio of an area of the conducting region to an entire area of the third two-dimensional element face which is designated to include the conducting region and the non-conducting region.

6. The plating analyzing apparatus as claimed in claim 5, wherein the potentials in the three-dimensional elements are taken at the center of gravity of the three-dimensional elements.

* * * * *